US008793126B2

(12) United States Patent
Gao

(10) Patent No.: US 8,793,126 B2
(45) Date of Patent: Jul. 29, 2014

(54) TIME/FREQUENCY TWO DIMENSION POST-PROCESSING

(75) Inventor: Yang Gao, Mission Viejo, CA (US)

(73) Assignee: Huawei Technologies Co., Ltd., Shenzhen (CN)

( * ) Notice: Subject to any disclaimer, the term of this patent is extended or adjusted under 35 U.S.C. 154(b) by 775 days.

(21) Appl. No.: 13/086,905

(22) Filed: Apr. 14, 2011

(65) Prior Publication Data

US 2011/0257979 A1 Oct. 20, 2011

Related U.S. Application Data

(60) Provisional application No. 61/323,873, filed on Apr. 14, 2010.

(51) Int. Cl.
*G10L 21/02* (2013.01)
*G10L 19/26* (2013.01)
*G10L 19/02* (2013.01)

(52) U.S. Cl.
CPC ..... *G10L 19/26* (2013.01); *G10L 19/0212* (2013.01)
USPC ..... 704/228

(58) Field of Classification Search
CPC ..... G10L 19/02; G10L 19/26
See application file for complete search history.

(56) References Cited

U.S. PATENT DOCUMENTS 4,630,305 A * 12/1986 Borth et al. ..... 381/94.3
5,651,071 A * 7/1997 Lindemann et al. ..... 381/314
6,377,637 B1 * 4/2002 Berdugo ..... 375/346
6,708,145 B1 * 3/2004 Liljeryd et al. ..... 704/200.1
7,013,011 B1 * 3/2006 Weeks et al. ..... 381/98
7,069,212 B2 * 6/2006 Tanaka et al. ..... 704/225
7,219,065 B1 * 5/2007 Vandali et al. ..... 704/278
7,260,520 B2 * 8/2007 Henn et al. ..... 704/212
7,742,914 B2 * 6/2010 Kosek et al. ..... 704/205
8,078,475 B2 * 12/2011 Tsushima ..... 704/500
8,352,257 B2 * 1/2013 Hetherington et al. ..... 704/226
8,457,956 B2 * 6/2013 Truman et al. ..... 704/228
2006/0239473 A1 10/2006 Kjorling et al.
2009/0086986 A1 * 4/2009 Schmidt et al. ..... 381/66
2009/0299755 A1 12/2009 Ragot et al.

FOREIGN PATENT DOCUMENTS

CN 101138274 A 3/2008
WO WO 03/102923 A2 12/2003
WO WO 2009/140896 A1 11/2009
WO WO 2011/127832 A1 10/2011

OTHER PUBLICATIONS

Haus, Goffredo, and Giancarlo Vercellesi. "State of the art and new results in direct manipulation of MPEG audio codes." Sound and Music Computing. Universitá di Salerno, 2005.*

(Continued)

*Primary Examiner* — Brian Albertalli
(74) *Attorney, Agent, or Firm* — Slater & Matsil, L.L.P.

(57) ABSTRACT

In accordance with an embodiment, a time-frequency post-processing method of improving perceptual quality of a decoded audio signal, the method includes determining a time-frequency representation (such as filter bank analysis and synthesis) of an audio signal, estimating a time-frequency energy distribution of an audio signal from a time-frequency filter bank, computing a modification gain for each time-frequency representation point to have a modified time-frequency representation, and outputting audio signal from a modified time-frequency representation.

22 Claims, 7 Drawing Sheets

(56) References Cited

OTHER PUBLICATIONS

Lee, Soojeong, and Soonhyob Kim. "Speech enhancement using gain function of noisy power estimates and linear regression." Frontiers in the Convergence of Bioscience and Information Technologies, 2007. FBIT 2007. IEEE, 2007.*

Lanciani, Chris A., and Ronald W. Schafer. "Subband-domain filtering of MPEG audio signals." Acoustics, Speech, and Signal Processing, 1999. Proceedings., 1999 IEEE International Conference on. vol. 2. IEEE, 1999.*

Touimi, Abdellatif Benjelloun. "A generic framework for filtering in subband domain." In Proc. of IEEE 9th Wkshp. on Digital Signal Processing, Hunt, Texas, USA (2000).*

"PCT International Search Report," International Application No. PCT/CN2011/072811, Applicant: Huawei Technologies Co., Ltd., mailing date: Jul. 21, 2011, 10 pages "Chinese Search Report," Chinese Application No. 2011800189412, Aug. 9, 2013, 2 pages.

* cited by examiner

TIME/FREQUENCY TWO DIMENSION POST-PROCESSING

This application claims the benefit of U.S. Provisional Application No. 61/323,873 filed on Apr. 14, 2010, entitled "Time/Frequency Two Dimension Post-processing," which application is incorporated by reference herein.

TECHNICAL FIELD

The present invention relates generally to audio/speech processing, and more particularly to a system and method for audio/speech coding, decoding and post-processing.

BACKGROUND

In modern audio/speech digital signal communication system, digital signal is compressed (encoded) at encoder; the compressed information (bitstream) can be packetized and sent to decoder through a communication channel frame by frame. The system of encoder and decoder together is called CODEC. Speech/audio compression may be used to reduce the number of bits that represent the speech/audio signal thereby reducing the bandwidth (bit rate) needed for transmission. However, speech/audio compression may result in quality degradation of decompressed signal. In general, a higher bit rate results in higher quality, while a lower bit rate causes lower quality.

Audio coding based on filter bank technology is widely used. In signal processing, a filter bank is an array of bandpass filters that separates the input signal into multiple components, each one carrying a single frequency subband of the original signal. The process of decomposition performed by the filter bank is called analysis, and the output of filter bank analysis is referred to as a subband signal with as many subbands as there are filters in the filter bank. The reconstruction process is called filter bank synthesis. In digital signal processing, the term filter bank is also commonly applied to a bank of receivers. The difference is that receivers also downconvert the subbands to a low center frequency that can be re-sampled at a reduced rate. The same result can sometimes be achieved by undersampling the bandpass subbands. The output of filter bank analysis could be in a form of complex coefficients; each complex coefficient contains real element and imaginary element respectively representing cosine term and sine term for each subband of filter bank.

In application of filter banks for signal compression, some frequencies are more important than others. After decomposition, the important frequencies can be coded with a fine resolution. Small differences at these frequencies are significant and a coding scheme that preserves these differences must be used. On the other hand, less important frequencies do not have to be exact. A coarser coding scheme can be used, even though some of the finer details will be lost in the coding. Typical coarser coding scheme is based on a concept of Band-Width Extension (BWE) which is widely used. This technology concept sometimes is also called High Band Extension (HBE), SubBand Replica (SBR) or Spectral Band Replication (SBR). Although the name could be different, they all have the similar meaning of encoding/decoding some frequency sub-bands (usually high bands) with little budget of bit rate (even zero budget of bit rate) or significantly lower bit rate than normal encoding/decoding approach. With SBR technology, the spectral fine structure in high frequency band is copied from low frequency band and some random noise could be added; then, the spectral envelope in high frequency band is shaped by using side information transmitted from encoder to decoder.

In some applications, post-processing at the decoder side is used to improve the perceptual quality of signals coded by low bit rate and SBR coding.

SUMMARY OF THE INVENTION

In accordance with an embodiment, a method of generating an encoded audio signal, the method includes estimating a time-frequency energy array of an audio signal from a time-frequency filter bank, computing two dimension energy evaluation envelope shapes of both time and frequency directions, determining a two dimension post-processing method according to the two dimension energy evaluation envelope shapes.

In accordance with a further embodiment, a method for generating an encoded audio signal includes receiving a frame comprising a time-frequency (T/F) representation of an input audio signal, the T/F representation having time slots, where each time slot has subbands. The method also includes estimating energy in subbands of the time slots, estimating a time energy evaluation envelope shape across a plurality of time slots, estimating a frequency evaluation envelope shape across a plurality of frequency subbands, determining energy modification factor (gain) for each time-frequency (T/F) point and applying the factor (gain) for each time-frequency (T/F) point.

In accordance with a further embodiment, a method of receiving an encoded audio signal, the method includes receiving an encoded audio signal comprising a coded representation of an input audio signal and a control code based on an audio signal class. The method further includes decoding the audio signal, applying T/F two dimension post-processing to the decoded audio signal in a first mode if the control code indicates that the audio signal class is of one audio class, and applying T/F two dimension post-processing to the decoded audio signal in a second mode if the control code indicates that the audio signal class is of another one audio class. The method further includes producing an output audio signal based on the T/F two dimension post-processed decoded audio signal.

In accordance with a further embodiment, a system for generating an encoded audio signal, the system includes a low-band signal parameter encoder for encoding a low-band portion of an input audio signal and a high-band time-frequency analysis filter bank producing high-band side parameters from the input audio signal. The system also includes applying stronger T/F two dimension post-processing to the high bands with more aggressive parameters and applying weak T/F two dimension post-processing to the low bands with less aggressive parameters.

In accordance with a further embodiment, a non-transitory computer readable medium has an executable program stored thereon, where the program instructs a microprocessor to decode an encoded audio signal to produce a decoded audio signal, where the encoded audio signal includes a coded representation of an input audio signal. The program also instructs the microprocessor to post-process the decoded audio signal with T/F two dimension post-processing approach.

The foregoing has outlined rather broadly the features of an embodiment of the present invention in order that the detailed description of the invention that follows may be better understood. Additional features and advantages of embodiments of the invention will be described hereinafter, which form the subject of the claims of the invention. It should be appreciated by those skilled in the art that the conception and specific embodiments disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the embodiments, and the advantages thereof, reference is now made to the following descriptions taken in conjunction with the accompanying drawings, in which:

FIG. 1, which includes FIG. 1*a* illustrates Filter-Bank encoder principle with T/F Post-processing and FIG. 1*b* illustrates Filter-Bank decoder principle with T/F Post-processing.

FIG. 2, which includes FIG. 2*a* illustrates Filter-Bank encoder principle with SBR and T/F Post-processing, wherein low band is encoded/decoded with Filter-Bank based approach and FIG. 2*b* illustrates Filter-Bank decoder principle with SBR and T/F Post-processing, wherein low band is encoded/decoded with Filter-Bank based approach.

FIG. 3, which includes FIG. 3*a* illustrates general principle of encoder with SBR and T/F Post-processing and FIG. 3*b* illustrates general principle of decoder with SBR and T/F Post-processing.

DETAILED DESCRIPTION OF ILLUSTRATIVE EMBODIMENTS

The making and using of the embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The present invention will be described with respect to various embodiments in a specific context, a system and method for audio coding and decoding. Embodiments of the invention may also be applied to other types of signal processing such as those used in medical devices, for example, in the transmission of electrocardiograms or other type of medical signals.

This invention introduced a concept of time/frequency two dimension post-processing, simply called T/F post-processing. The T/F post-processing is applied on the coefficients outputted from filter bank analysis; in other words, the output from filter bank analysis is modified by the T/F post-processing before going to filter bank synthesis. The purpose of the T/F post-processing is to improve the perceptual quality of audio coding at low bit rates while the cost of doing the T/F post-processing is very low. The time/frequency two dimension post-processing block is placed at decoder side before doing filter bank synthesis; the exact location of this T/F post-processing module depends on the encoding/decoding schemes. FIG. 1, FIG. 2, FIG. 3, and FIG. 4 have shown some typical examples of applying T/F two dimension post-processing.

Figure 1A:
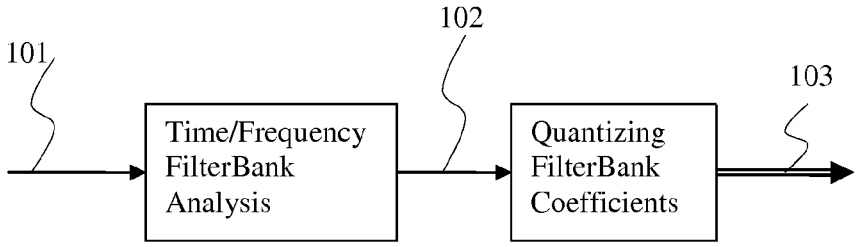
FIGS. 1*a* and 1*b*, illustrates Filter-Bank encoder and decoder principle with T/F Post-processing where
Figure 1B:
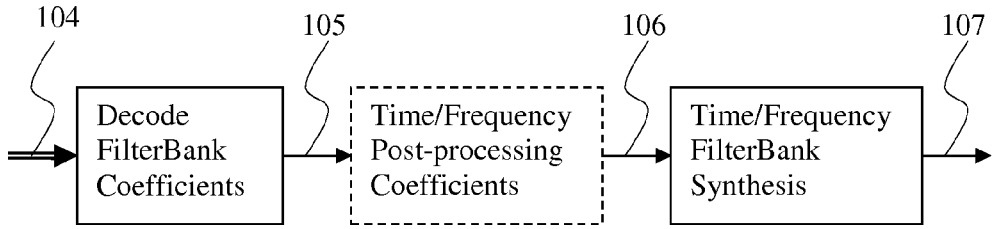

In FIG. 1, original audio signal 101 at encoder is transformed by filter bank analysis. The output coefficients 102 from filter bank analysis are quantized and transmitted to decoder through bitstream channel 103. At decoder, the quantized filter bank coefficients 105 are decoded by using bitstream 104 from transmission channel; then, they are post-processed to obtain post-processed filter bank coefficients 106 before going to filter bank synthesis which produces the output audio signal 107.

Figure 2A:
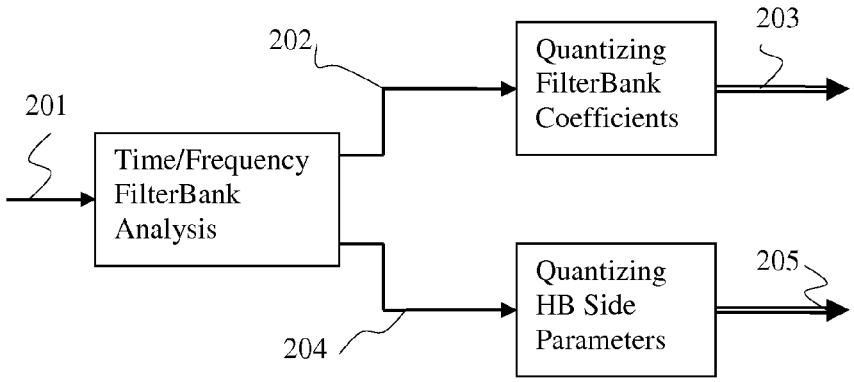
FIGS. 2*a* and 2*b*, illustrates a Filter-Bank encoder and decoder principle with SBR and T/F Post-processing, wherein low band is encoded/decoded with Filter-Bank based approach. In particular.
Figure 2B:
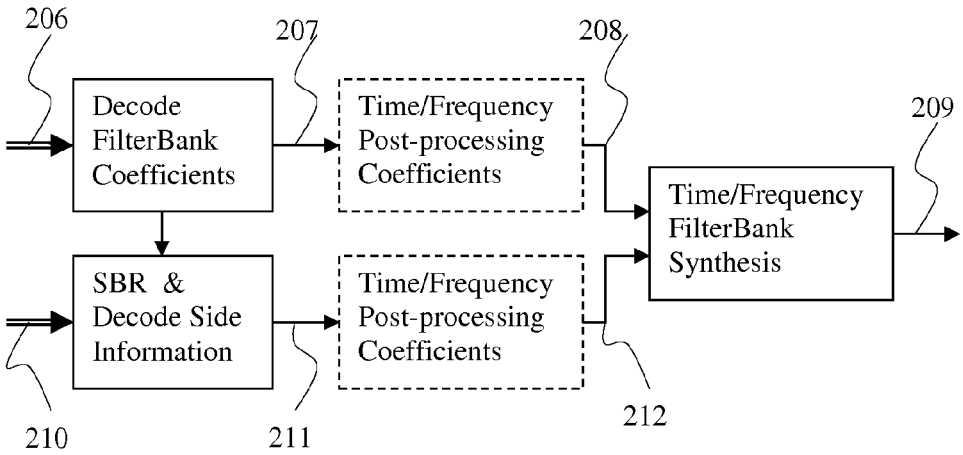

In FIG. 2, the low band signal is encoded/decoded in a similar way as shown in FIG. 1. Original audio signal 201 at encoder is transformed by filter bank analysis; the low frequency band output coefficients 202 from filter bank analysis are quantized and transmitted to decoder through bitstream channel 203. The high band signal is encoded/decoded with SBR technology; only the high band side information 204 is quantized and transmitted to decoder through bitstream channel 205. At decoder, the low band quantized filter bank coefficients 207 are decoded by using bitstream 206 from transmission channel. The high band filter bank coefficients 211 are generated by using SBR technology and the side information decoded from bitstream 210. Both the low band and high band filter bank coefficients are post-processed. Usually, SBR coding in high band is coarser than normal coding in low band so that post-processing in high band should be stronger while post-processing in low band should be weaker. The low band post-processed filter bank coefficients 208 and the high band post-processed filter bank coefficients 212 are combined before sent to filter bank synthesis which produces the output audio signal 209.

Figure 3A:
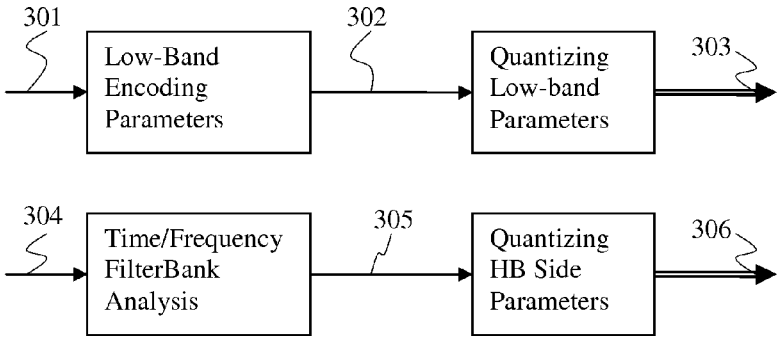
FIGS. 3*a* and 3*b*, illustrates general principle of encoder and decoder with SBR and T/F Post-processing, wherein low band is not necessary to be encoded/decoded with Filter-Bank based approach. In particular.
Figure 3B:
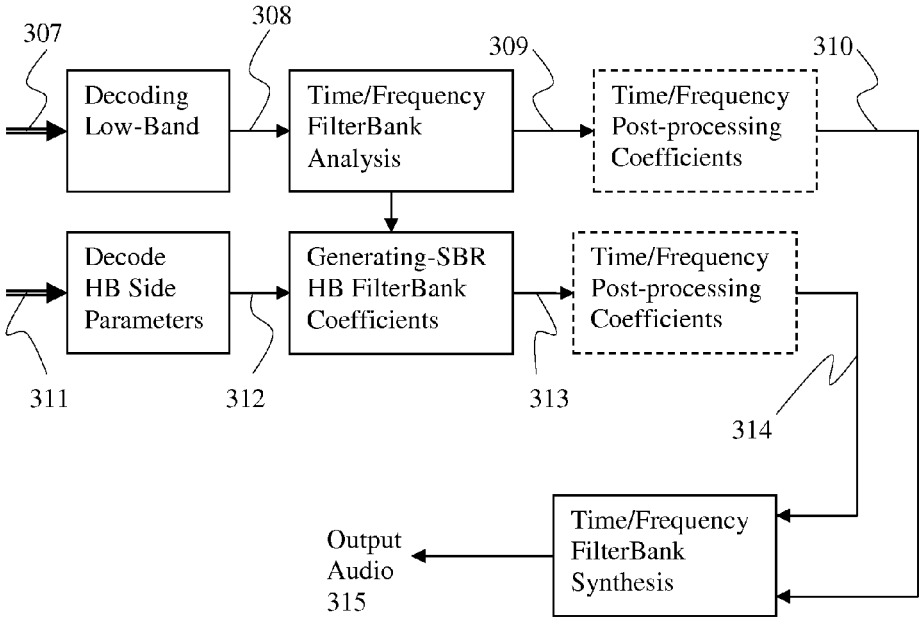

In FIG. 3, suppose that the low band signal is encoded/decoded with any coding scheme while the high band is encoded/decoded with low bit rate SBR scheme. Original low band audio signal 301 at encoder is encoded to have the corresponding low band parameters 302 which are then are quantized and transmitted to decoder through bitstream channel 303. The high band signal 304 is encoded/decoded with SBR technology; only the high band side information 305 is quantized and transmitted to decoder through bitstream channel 306. At decoder, the low band bitstream 307 is decoded with any coding scheme to obtain the low band signal 308 which is again transformed into the low band filter bank output coefficients 309 by filter bank analysis. The high band side bitstream 311 is decoded to have the high band side parameters 312 which usually contain the high band spectral envelope. The high band filter bank coefficients 313 are generated by copying the low band filter bank coefficients, shaping the high band spectral energy envelope with received side information, and adding proper random noise. Both the low band and high band filter bank coefficients are post-processed. Usually, post-processing in high band should be stronger while post-processing in low band should be weaker. The low band post-processed filter bank coefficients 310 and the high band post-processed filter bank coefficients 314 are combined before sent to filter bank synthesis which produces the output audio signal 315.

Figure 4:
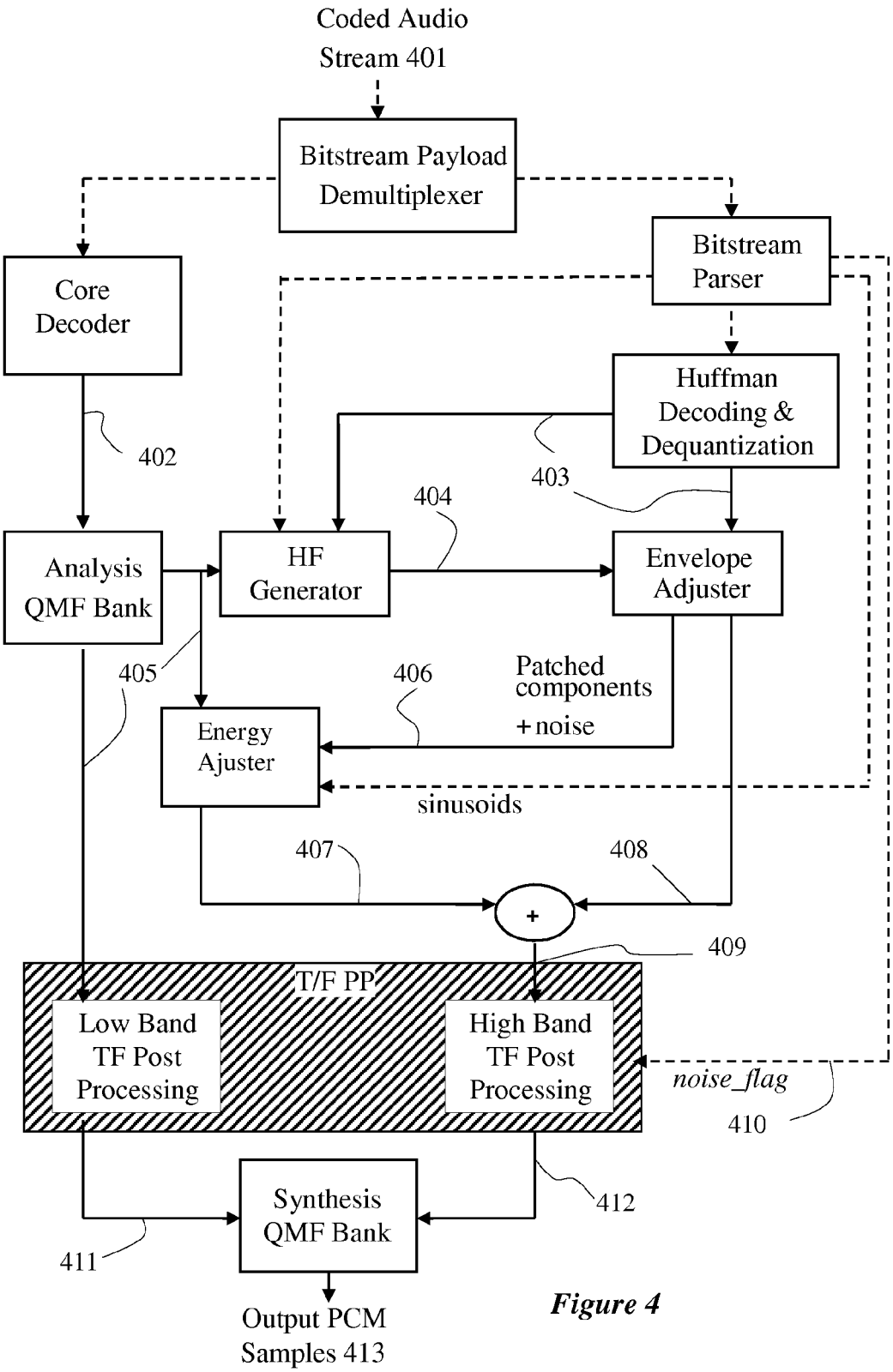
FIG. 4 illustrates T/F Post-processing with specific decoder.

In FIG. 4, the low band signal is encoded/decoded with time domain coding scheme while the high band is encoded/decoded with low bit rate SBR frequency domain coding scheme. Original low band audio signal at encoder is encoded and the corresponding low band parameters are quantized and transmitted to decoder through bitstream channel. At decoder, the received bitstream 401 comprises two major portions, one 402 for low band signal and another one 403 for high band signal. The low band bitstream 402 is decoded with the time domain coding scheme to obtain the low band signal 404 which is again transformed into the low band filter bank output coefficients 407 by filter bank analysis. The high band signal is encoded/decoded with specific SBR technology. The high band side information is quantized and transmitted to decoder through the bitstream 403 which mainly contains the high band spectral envelope information. The high band spectral envelope 405 is dequantized by Huffman decoding scheme. The high band side bitstream also contains other information which controls the high band generation and the T/F post-processing, in which the bit noise_flag 412 is used to activate/deactivate the T/F post-processing. The major high band filter bank coefficients 406 are generated by copying the low band filter bank coefficients and shaping the high band spectral energy envelope 405 with received side information to form the shaped high band filter bank coefficients 410. The another portion of the high band filter bank coefficients 409 are formed and controlled by adding proper harmonics and random noise 408. Both the low band filter bank coefficients 407 and the summed high band filter bank coefficients 411 are post-processed respectively. Usually, post-processing in high band should be stronger while post-processing in low band should be weaker. The low band post-processed filter bank coefficients 413 and the high band post-processed filter bank coefficients 414 are sent to filter bank synthesis which produces the output audio signal 415.

Figure 5:
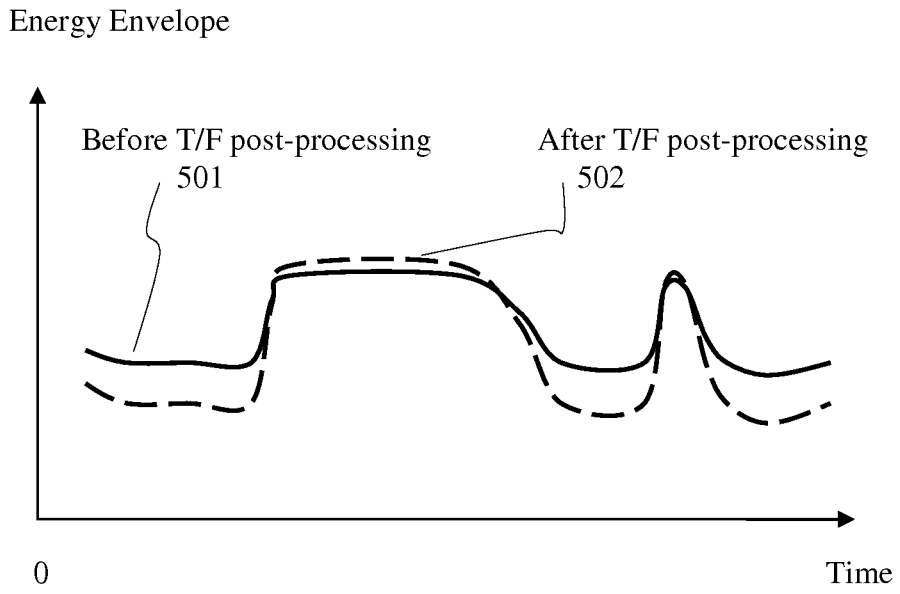
FIG. 5 illustrates temporal energy envelope comparison before and after T/F post-processing.
Figure 6:
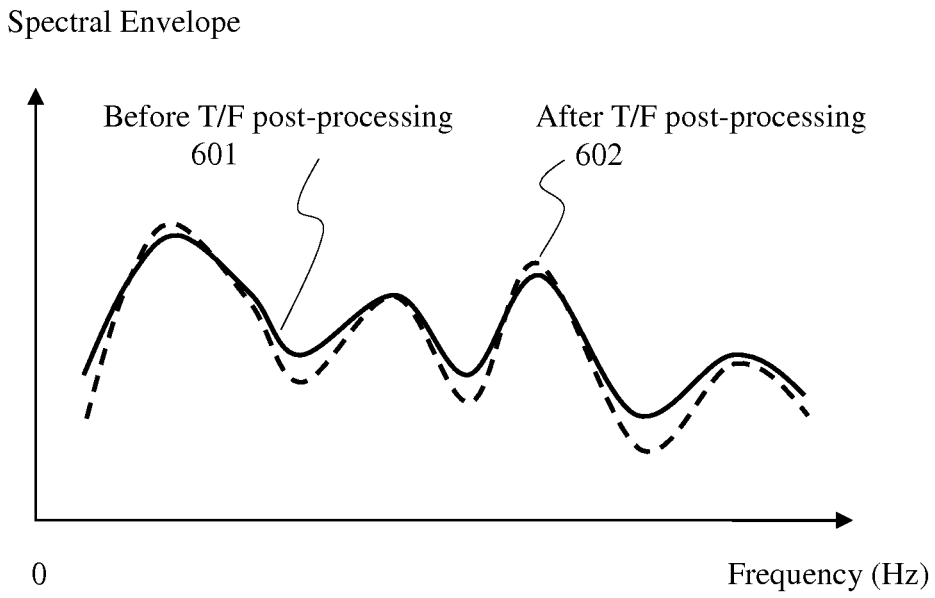
FIG. 6 illustrates spectral energy envelope comparison before and after T/F post-processing.

Audio low bit rate coding always introduces some distortion. In frequency domain, low energy valley area usually has more distortion than high energy peak area. In time domain, the distortion often behaves like that fast time envelope change in original signal becomes slow time envelope change in decoded signal. Energy array of filter bank coefficients can often represent two dimension energy variation in time direction and frequency direction. So, T/F post-processing of filter bank coefficients can change energy evaluation envelope shape of both time and frequency directions. As a result after post-processing, time energy envelope evaluation would change faster (closer to original shape), energy in more distorted area is reduced, and energy in high quality area is increased to keep overall energy unchanged. FIG. 5 explains an example of time energy envelope shape 501 before T/F post-processing and time energy envelope shape 502 after T/F post-processing. FIG. 6 gives an example of spectral envelope shape 601 before T/F post-processing and spectral envelope shape 602 after T/F post-processing.

The following T/F post-processing algorithm is an example based on FIG. 3 and FIG. 4. This example is related to MPEG-4 technology. The algorithm can be summarized as the following steps.

Estimating T/F energy array simply from available FilterBank complex coefficients for a long frame of 2048 output samples at decoder:

$$X(l,k)=\{Sr[l][k],Si[l][k]\} \tag{1}$$

$$TF_energy_low[l][k]=X(l,k)X^*(l,k)=(Sr[l][k])^2+(Si[l][k])^2, l=0,1,2,\ldots,31;\ k=0,1,\ldots,K_{low}-1 \tag{2}$$

$$TF_energy_high[l][k]=X(l,k)X^*(l,k)=(Sr[l][k])^2+(Si[l][k])^2, l=0,1,2,\ldots,31;\ k=K_{low},\ldots,K_{total}-1 \tag{3}$$

X(l,k) is a FilterBank complex coefficient. Sr[l][k] is real component of X(l,k). Si[l][k] is imaginary component of X(l,k). $K_{low}$ defines the number of subbands in low frequency band; $K_{total}$ defines the total number of subbands covering both low band and high band; the values of $K_{low}$ and $K_{total}$ depend on the bit rates. l is the time index which represents 2.5 ms step for an 12 kbps codec at sampling rate of 25600 Hz, and 3.335 ms step for an 8 kbps codec at sampling rate of 19200 Hz; k is the frequency index indicating 200 Hz step for the 12 kbps codec and 150 Hz step for the 8 kbps codec. Sr[l][k] and Si[l][k] are available FilterBank complex coefficients at decoder. TF_energy_low[l][k] represents energy distribution for low band in time/frequency two dimensions; TF_energy_high[l][k] represents energy distribution for high band (or called SBR band). In the following description, the notation TF_energy_low[l][k] and TF_energy_high[l][k] will be simply noted as TF_energy[l][k] because the same post-processing algorithm will be used for low band and high band while only the controlling parameters of the post-processing algorithm will be different for low band and high band; usually, weak post-processing is for low band and strong post-processing for high band as SBR band is noisier than low band.

Estimating time direction energy distribution by averaging frequency direction energies:

$$T_energy[l] = Average\{TF_energy[l][k], \text{ for all } k \text{ of specific range}\} = \frac{1}{(K1-K0)}\sum_{k=K0}^{K1-1} TF_energy[l][k], \tag{4}$$

K0=0 and K1=$K_{low}$ for low band; K0=$K_{low}$ and K1=$K_{total}$ for high band.

T_energy[l] can be smoothed from previous time index to current time index by excluding energy dramatic change (not smoothed at dramatic energy change point); if the smoothed T_energy[l] is noted as T_energy_sm[l], an example of T_energy_sm[l] can be expressed as

```
    if ( (T__energy[l]>T__energy__sm[l−1]*8) or
                (T__energy[l]<T__energy__sm[l−1]/16) )
            {
                    T__energy__sm[l] = T__energy[l];
    }
    else if ( (T__energy[l]>T__energy__sm[l−1]*4) or
                        (T__energy[l]<T__energy__sm[l−1]/8) )
        {
      T__energy__sm[l] = (T__energy__sm[l−1] + T__energy[l])/2 ;
    }
    else {
        T__energy__sm[l] = (3*T__energy__sm[l−1] + T__energy[l])/4 ;
}
```

Estimating frequency direction energy distribution by averaging time direction energies:

$$F_energy[k] = Average\{TF_energy[l][k], \text{ for all } l \text{ of specific range}\} = \frac{1}{(L1-L0)}\sum_{l=L0}^{L1-1} TF_energy[l][k], \tag{5}$$

One frame or one block is defined from l=L0 to l=L1, which typically last 20 milliseconds. F_energy[k] can be smoothed from previous time block to current time block; if the smoothed F_energy[k] in current time block is noted as F_energy_sm$^{(current)}$[k], an example of F_energy_sm$^{(current)}$[k] can be expressed as, $$F_energy_sm^{(current)}[k]=(F_energy_sm^{(previous)}[k]+F_energy[k])/2 \tag{6}$$

Estimating time direction energy modification gains by calculating the following initial gains:

$$\begin{aligned}\text{Gain_t}[l] &= pow(\text{T_energy_sm}[l], \text{t_control}) \\ &= (\text{T_energy_sm}[l])^{t_control}\end{aligned} \tag{7}$$

t_control is a constant parameter usually between 0.05 and 0.15. t_control=0 means no post-processing is applied. An example value of t_control for low band is 0.05 and an example value of t_control for high band is 0.1. If t_control is set to 0 for very noisy or stationary signal and 0.1 for clean speech signal, a value of t_control=0.05 can be set for some signal classified as in-between noisy and clean signal. Weaker post-processing (t_control is closer to 0 and gain value is closer to 1) is applied for frequency band or frame of higher coding quality; stronger (t_control is larger and gain value is away from 1) post-processing is applied for frequency band or frame of lower coding quality.

The initial gains Gain_t[l] should be energy-normalized at each time index by comparing the strongly smoothed original energy to the strongly smoothed energy of after putting the initial gains:

$$\text{T_energy_0_sm}[l] = (31\cdot\text{T_energy_0_sm}[l-1]+\text{T_energy}[l])/32 \tag{8}$$

$$\text{T_energy_1_smp}[l] = (31\cdot\text{T_energy_1_sm}[l-1]+\text{T_energy}[l]\cdot(\text{Gain_t}[l])^2)/32 \tag{9}$$

$$\text{Gain_t_norm}[l] = \sqrt{\frac{\text{T_energy_0_sm}[l]}{\text{T_energy_1_sm}[l]}} \tag{10}$$

The normalization gain Gain_t_norm[l] is applied to the initial gains for each time index to obtain the final time direction modification gains:

$$\text{Gain_}t[l] \Leftarrow \text{Gain_}t\text{_norm}[l]\cdot\text{Gain_}t[l] \tag{11}$$

The gains are limited to certain variation range. Typical limitation could be $$0.6 \le \text{Gain_}t[l] \le 1.1 \tag{12}$$

Estimating frequency direction energy modification gains by calculating the initial gains:

$$\begin{aligned}\text{Gain_f}[k] &= pow(\text{F_energy_sm}^{(current)}[k], \text{f_control}) \\ &= (\text{F_energy_sm}^{(current)}[k])^{f_control}\end{aligned} \tag{13}$$

f_control is a constant parameter usually between 0.05 and 0.15. f_control=0 means no post-processing is applied. An example value of f_control for low band is 0.05 and an example value of f_control for high band is 0.1. If f_control is set to 0 for very noisy or stationary signal and 0.1 for clean speech signal, a value of f_control=0.05 can be set for some signal classified as in-between noisy and clean signal. Weaker post-processing (f_control is closer to 0 and gain value is closer to 1) is applied for frequency band or frame of higher coding quality; stronger (f_control is larger and gain value is away from 1) post-processing is applied for frequency band or frame of lower coding quality.

Some simple tilt compensation can be added for the initial gains to avoid possible too low high frequency energy of particular signals, such as, $$\text{Gain_f}[k] \Leftarrow (1+k\cdot\text{Tilt})\cdot\text{Gain_f}[k], \quad k = K0, K0+1, \ldots, K1-1; \tag{14}$$

$$\text{Tilt} = \begin{cases} 0, & \text{if energy 1} > \text{energy 0} \\ \dfrac{W\cdot\text{f_control}}{(K1-K0)}\cdot\sqrt{\dfrac{(\text{energy 0}-\text{energy 1})}{(\text{energy 0}+\text{energy 1})}}, & \text{others} \end{cases} \tag{15}$$

$$\text{energy 0} = \sum_{k=K0}^{(K0+K1)/2-1} \text{F_energy_sm}^{(current)}[k] \tag{16}$$

$$\text{energy 1} = \sum_{k=(K0+K1)/2}^{K1-1} \text{F_energy_sm}^{(current)}[k] \tag{17}$$

In (15), W is a constant value depending on the location of the frequency region.

The initial gains Gain_f[k] should be also energy-normalized at each time index by comparing the original energy to the energy of after putting the initial gains:

$$\text{F_energy_0}[l] = \sum_{k=K0}^{K1-1} \text{TF_energy}[l][k] \tag{18}$$

$$\text{F_energy_1}[l] = \sum_{k=K0}^{K1-1} \text{TF_energy}[l][k]\cdot(\text{Gain_f}[k])^2 \tag{19}$$

$$\text{Gain_f_norm}[l] = \sqrt{\frac{\text{F_energy_0}[l]}{\text{F_energy_1}[l]}} \tag{20}$$

The normalization gain Gain_f_norm[l] is applied to the initial gains at each time index to obtain the final frequency direction modification gains:

$$\text{Gain_}f[k] \Leftarrow \text{Gain_}f\text{_norm}[l]\cdot\text{Gain_}f[k] \tag{21}$$

The gains are limited to certain variation range. Typical limitation could be $$0.6 \le \text{Gain_}f[k] \le 1.1 \tag{22}$$

Estimating final two dimension energy modification gains for each T/F point in the T/F array:

$$\text{Gain_}tf[l][k]=\text{Gain_}t[l]\cdot\text{Gain_}f[k] \tag{23}$$

The gains are limited to certain variation range. Typical limitation could be $$0.6 \le \text{Gain_}tf[l][k] \le 1.1 \tag{24}$$

Further energy normalization could be added. In order to reduce the number of the square root and division operations, the normalization factors (10) and (20) can be estimated and applied together to the final gains in the final step:

$$\text{Gain_tf_norm}[l] = \sqrt{\frac{(\text{T_energy_0_sm}[l] \cdot \text{F_energy_0}[l])}{(\text{T_energy_1_sm}[l] \cdot \text{F_energy_1}[l])}} \quad (25)$$

$$\text{Gain_tf}[l][k] \Leftarrow \text{Gain_tf_norm}[l] \cdot \text{Gain_tf}[l][k] \quad (26)$$

Applying the final T/F gains to each corresponding T/F FilterBank complex coefficient to obtain the modified FilterBank complex coefficients before sent to FilterBank Synthesis:

$$X(l,k) \Leftarrow \text{Gain_}tf[l][k] \cdot X(l,k) \quad (27)$$

or $$Sr[l][k] \Leftarrow \text{Gain_}tf[l][k] \cdot Sr[l][k] \quad (28)$$

$$Si[l][k] \Leftarrow \text{Gain_}tf[l][k] \cdot Si[l][k] \quad (29)$$

Figure 7:
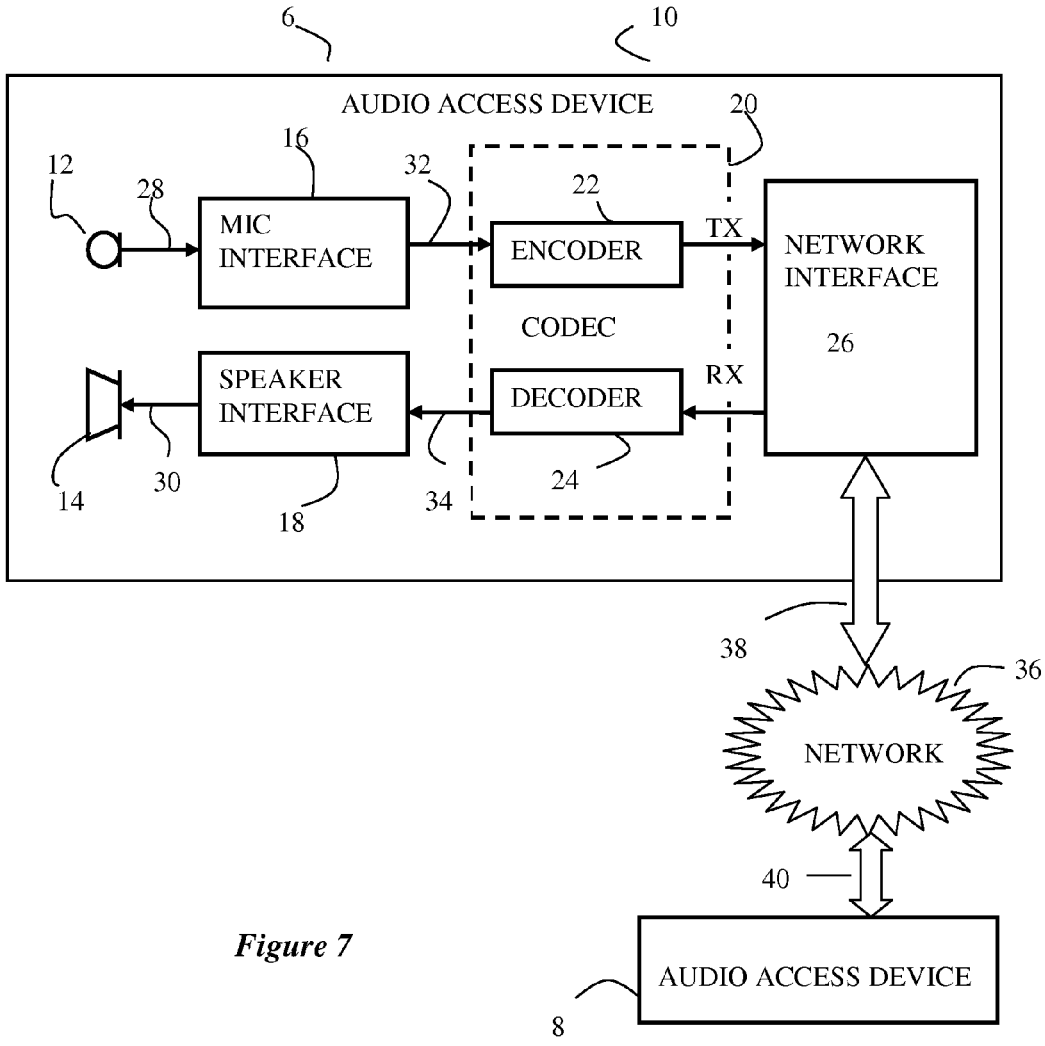
FIG. 7 illustrates a communication system according to an embodiment of the present invention.

FIG. 7 illustrates communication system 10 according to an embodiment of the present invention. Communication system 10 has audio access devices 6 and 8 coupled to network 36 via communication links 38 and 40. In one embodiment, audio access device 6 and 8 are voice over internet protocol (VOIP) devices and network 36 is a wide area network (WAN), public switched telephone network (PSTN) and/or the internet. In another embodiment, audio access device 6 is a receiving audio device and audio access device 8 is a transmitting audio device that transmits broadcast quality, high fidelity audio data, streaming audio data, and/or audio that accompanies video programming. Communication links 38 and 40 are wireline and/or wireless broadband connections. In an alternative embodiment, audio access devices 6 and 8 are cellular or mobile telephones, links 38 and 40 are wireless mobile telephone channels and network 36 represents a mobile telephone network.

Audio access device 6 uses microphone 12 to convert sound, such as music or a person's voice into analog audio input signal 28. Microphone interface 16 converts analog audio input signal 28 into digital audio signal 32 for input into encoder 22 of CODEC 20. Encoder 22 produces encoded audio signal TX for transmission to network 26 via network interface 26 according to embodiments of the present invention. Decoder 24 within CODEC 20 receives encoded audio signal RX from network 36 via network interface 26, and converts encoded audio signal RX into digital audio signal 34. Speaker interface 18 converts digital audio signal 34 into audio signal 30 suitable for driving loudspeaker 14.

In embodiments of the present invention, where audio access device 6 is a VOIP device, some or all of the components within audio access device 6 can be implemented within a handset. In some embodiments, however, Microphone 12 and loudspeaker 14 are separate units, and microphone interface 16, speaker interface 18, CODEC 20 and network interface 26 are implemented within a personal computer. CODEC 20 can be implemented in either software running on a computer or a dedicated processor, or by dedicated hardware, for example, on an application specific integrated circuit (ASIC). Microphone interface 16 is implemented by an analog-to-digital (A/D) converter, as well as other interface circuitry located within the handset and/or within the computer. Likewise, speaker interface 18 is implemented by a digital-to-analog converter and other interface circuitry located within the handset and/or within the computer. In further embodiments, audio access device 6 can be implemented and partitioned in other ways known in the art.

In embodiments of the present invention where audio access device 6 is a cellular or mobile telephone, the elements within audio access device 6 are implemented within a cellular handset. CODEC 20 is implemented by software running on a processor within the handset or by dedicated hardware. In further embodiments of the present invention, audio access device may be implemented in other devices such as peer-to-peer wireline and wireless digital communication systems, such as intercoms, and radio handsets. In applications such as consumer audio devices, audio access device may contain a CODEC with only encoder 22 or decoder 24, for example, in a digital microphone system or music playback device. In other embodiments of the present invention, CODEC 20 can be used without microphone 12 and speaker 14, for example, in cellular base stations that access the PSTN.

Advantages of embodiments include improvement of subjective received sound quality at low bit rates with low cost.

Although the embodiments and their advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.ts.

What is claimed is:

1. A post-processing method of generating a decoded audio signal, the method comprising:

estimating a time-frequency energy array of a decoded audio signal from a time-frequency filter bank;

estimating a time direction energy distribution by averaging frequency direction energies;

estimating a frequency direction energy distribution by averaging time direction energies;

estimating time direction energy modification gains based on the time direction energy distribution;

estimating frequency direction energy modification gains based on the frequency direction energy distribution;

estimating final two dimension energy modification gains for each T/F point of the time-frequency filter bank;

applying the final T/F gains to each corresponding T/F point of the time-frequency filter bank to obtain the modified filter bank coefficients before sent to filter bank synthesis; and outputting final audio signal from the filter bank synthesis.

2. The method of claim 1, wherein estimating a time-frequency energy array comprises estimating the energy array from a time-frequency filter bank complex coefficients.

3. The method of claim 1, wherein estimating a time direction energy distribution comprises estimating a smoothed time direction energy distribution from one time index to next time index.

4. The method of claim 1, wherein estimating a frequency direction energy distribution comprises estimating a smoothed frequency direction energy distribution from one time block to next time block.

5. The method of claim 1, wherein estimating time direction energy modification gains comprises estimating initial time direction gains:

$$\text{Gain_t}[l] = pow(\text{T_energy_sm}[l], \text{t_control}) = (\text{T_energy_sm}[l])^{t_control}$$

where T_energy_sm[l] represents time direction energy distribution and t_control is a constant controlling parameter.

6. The method of claim 1, wherein t_control has a value of 0.05 for low band and t_control has a value of 0.1 for high band.

7. The method of claim 1, wherein estimating time direction energy modification gains comprises applying energy normalization factors to initial time direction gains:

$$\text{Gain_}t[l] \Leftarrow \text{Gain_}t\text{_norm}[l] \cdot \text{Gain_}t[l]$$

wherein the energy normalization factor Gain_t_norm[l] is obtained by comparing the strongly smoothed original energy T_energy__0_sm[l] to the strongly smoothed energy T_energy__1_sm[l] of after putting the initial gains:

$$\text{Gain_t_norm}[l] = \sqrt{\frac{\text{T_energy_0_sm}[l]}{\text{T_energy_1_sm}[l]}}.$$

8. The method of claim 1, wherein estimating frequency direction energy modification gains comprises estimating initial frequency direction gains:

$$\text{Gain_f}[k] = pow(\text{F_energy_sm}^{(current)}[k], \text{f_control}) = (\text{F_energy_sm}^{(current)}[k])^{f_control}$$

where $\text{F_energy_sm}^{(current)}[k]$ represents frequency direction energy distribution; f_control is a constant controlling parameter.

9. The method of claim 8, wherein f_control has a value of 0.05 for low band and f_control has a value of 0.1 for high band.

10. The method of claim 1, wherein estimating frequency direction energy modification gains comprises tilt compensation to avoid possible too low high frequency energy of particular signals.

11. The method of claim 1, wherein estimating frequency direction energy modification gains comprises using the formula:

$$\text{Gain_}f[k] \Leftarrow (1+k\cdot\text{Tilt})\cdot\text{Gain_}f[k], k=K0, K0+1, \ldots, K1-1;$$

where Tilt is an adaptive coefficient to control the tilt compensation.

12. The method of claim 1, wherein estimating frequency direction energy modification gains comprises applying energy normalization factors to initial frequency direction gains:

$$\text{Gain_}f[k] \Leftarrow \text{Gain_}f\text{_norm}[l] \cdot \text{Gain_}f[k]$$

wherein an energy normalization factor Gain_f_norm[l] is obtained by comparing the original energy F_energy__0[l] to the energy F_energy__1[l] of after putting the initial gains:

$$\text{Gain_f_norm}[l] = \sqrt{\frac{\text{F_energy_0}[l]}{\text{F_energy_1}[l]}}.$$

13. The method of claim 1, wherein estimating the final two dimension energy modification gains for each T/F point of filter bank T/F array:

$$\text{Gain_}tf[l][k] = \text{Gain_}t[l] \cdot \text{Gain_}f[k]$$

wherein, the gains are limited to a certain variation range.

14. The method of claim 13, wherein the certain variation range meets the criteria $$0.6 \le \text{Gain_}tf[l][k] \le 1.1.$$

15. The method of claim 1, wherein estimating the final two dimension energy modification gains comprises estimating and applying the time gain normalization and the frequency gain normalization together to the final gains in the final step:

$$\text{Gain_tf_norm}[l] = \sqrt{\frac{(\text{T_energy_0_sm}[l] \cdot \text{F_energy_0}[l])}{(\text{T_energy_1_sm}[l] \cdot \text{F_energy_1}[l])}}$$

$$\text{Gain_tf}[l][k] \Leftarrow \text{Gain_tf_norm}[l] \cdot \text{Gain_tf}[l][k].$$

16. The method of claim 1, wherein applying the final T/F gains comprises multiplying the T/F gains Gain_tf[l][k] to each corresponding T/F point X(l,k) of the time-frequency filter bank:

$$X(l,k) \Leftarrow \text{Gain_}f[l][k] \cdot X(l,k)$$

or $$Sr[l][k] \Leftarrow \text{Gain_}tf[l][k] \cdot Sr[l][k]$$

$$Si[l][k] \Leftarrow \text{Gain_}tf[l][k] \cdot Si[l][k].$$

17. A post-processing method of generating a decoded audio signal, the method comprising:

receiving a frame comprising a time-frequency (T/F) representation of an input audio signal, the T/F representation having time slots, each time slot having frequency subbands;

estimating energy distribution in the time slots and the frequency subbands;

estimating post-processing modification gain for each T/F point of time slot and frequency subband according to the T/F energy distribution;

making the modification gain smaller at T/F point of lower energy;

making the over all energy of after the T/F post-processing equivalent to the one of before the T/F post-processing;

applying the final T/F gains to each corresponding T/F point to obtain the modified T/F representation; and outputting final audio signal from the modified T/F representation.

18. The method of claim 17, further comprising producing the coded representation of the input audio signal, producing the coded representation of the input audio signal comprising:

producing a low-band signal from the input audio signal;

producing low-band parameters from the low band signal;

producing the T/F representation of the input audio signal from the input audio signal; and producing high-band parameters from the T/F representation of the input audio signal, wherein the coded representation of the input audio signal includes the low-band parameters and the high-band parameters.

19. The method of claim 17, wherein the coded representation of the input audio signal comprises a low-band bitstream and a high-band bitstream and wherein decoding the audio signal comprises:

decoding the low-band bitstream to produce a low-band signal, producing low-band coefficients by performing a time-frequency filter bank analysis of the low-band signal, decoding the high-band bitstream to produce high-band side parameters, generating high-band coefficients based on the high-band side parameters and based on the producing low-band coefficients;

post-processing the decoded audio signal comprises modifying the low-band coefficients and the high-band coefficients to correct for audio coding artifacts to produce modified low-band coefficients and modified high-band coefficients; and producing the audio signal comprises performing a time-frequency filter bank synthesis of the modified low-band coefficients and modified high-band coefficients.

20. The method of claim 17, wherein weaker post-processing is applied for low frequency band and stronger post-processing is applied for high frequency band, wherein a gain value is closer to 1 for the weaker post-processing than for the stronger post-processing.

21. The method of claim 17, wherein weaker post-processing is applied for frequency band of higher coding quality and stronger post-processing is applied for frequency band of lower coding quality, wherein a gain value is closer to 1 for the weaker post-processing than for the stronger post-processing.

22. The method of claim 17, wherein weaker post-processing is applied for frame of higher coding quality and stronger post-processing is applied for frame of lower coding quality, wherein a gain value is closer to 1 for the weaker post-processing than for the stronger post-processing.

* * * * *

UNITED STATES PATENT AND TRADEMARK OFFICE

CERTIFICATE OF CORRECTION

PATENT NO. : 8,793,126 B2
APPLICATION NO. : 13/086905
DATED : July 29, 2014
INVENTOR(S) : Yang Gao It is certified that error appears in the above-identified patent and that said Letters Patent is hereby corrected as shown below:

In the Claims

In Col. 12, line 32, claim 16 delete "X(l,k)⇐ Gain_[l][k] ·X(l,k)" and insert --X(l,k)⇐Gain_tf[l][k]·X(l,k)--.

Signed and Sealed this
Eighteenth Day of November, 2014

Michelle K. Lee

Michelle K. Lee
*Deputy Director of the United States Patent and Trademark Office*